United States Patent [19]

Oka

[11] Patent Number: 4,678,098

[45] Date of Patent: Jul. 7, 1987

[54] FASTENING STRUCTURE OF TUBE AND CAR ASSEMBLY

[76] Inventor: Yasuo Oka, 23-24 Yohsai, Momoyama-cho, Fushimi-ku, Kyoto-shi, Kyoto-fu, Japan

[21] Appl. No.: 843,234

[22] Filed: Mar. 24, 1986

[51] Int. Cl.[4] ..... B65D 41/04

[52] U.S. Cl. ..... 220/289; 222/81; 222/83

[58] Field of Search ..... 220/288, 289, 277; 222/81, 83, 541

[56] References Cited

U.S. PATENT DOCUMENTS 3,109,562 11/1963 Ferris ..... 222/81

*Primary Examiner*—George T. Hall

*Attorney, Agent, or Firm*—Jones & Askew

[57] ABSTRACT

A fastening structure of a tube and cap assembly is provided. The structure includes an unthreaded part formed in the threaded portion of cap or of a mouth member of tube. The unthreaded part acts as a stopper to keep the cap being secured to the mouth member of tube, but if the cap is forcibly screwed further, the unthreaded part is rolled and deformed by the other threaded portion which does not include the unthreaded part to form threads on the unthreaded part. Due to this forcible action, a conical cutting edge, if it is provided on the inner bottom surface of cap, is pressed against the sealed mouth of tube to break the sealed mouth.

9 Claims, 12 Drawing Figures

FASTENING STRUCTURE OF TUBE AND CAR ASSEMBLY

BACKGROUND OF THE INVENTION

1. Field of the Invention

The present invention relates to a cap and tube assembly, and particularly to a fastening structure of the tube and cap assembly.

2. Description of the Prior Art

FIG. 1 shows the structure of a conventional cap 101 which is fastened to a sealed mouth 103 of a tube. The outer end of cap 101 is provided with a conical cutting edge 105. To open the sealed mouth 103, the cap 101 is removed from the tube, and the cutting edge 105 is pushed against the sealed mouth 103 until the sealed mouth 103 is broken by the cutting edge 105. In this case, a threaded portion 107 of the tube and an inner threaded portion of cap 101 are formed to perform an ordinary screwing motion and used only for fastening and unfastening the cap 101 with respect to the tube. After opening the mouth 103 by the edge 105, the edge 105 will be wet with gel like material such as chemicals contained in the tube. Such chemicals on the edge 105 will be dried and dispersed in the air to contaminate a sanitary environment.

Japanese Utility Model No. 54-134152 discloses another example of a cap. In this example, the cap is provided on its inner bottom surface with a conical cutting edge. To prevent the cutting edge from breaking a sealed mouth of the tube, an intermediate ring is arranged between the shoulder portion of tube and the cap. If it is desired to open the sealed mouth of tube, the intermediate ring is removed, and the cap is further screwed toward the tube until the cutting edge of cap breaks the sealed mouth of tube. Similar to the previous example, a threaded portion of the tube and an inner threaded portion of the cap of this example are formed to perform an ordinary screwing function and used only for fastening and unfastening the cap with respect to the tube. This example is not practical in use, because a very complicated process is required for assembling the intermediate ring in manufacturing the tube and cap assembly and for removing the intermediate ring in opening the sealed mouth of tube before use.

SUMMARY OF THE INVENTION

An object of the present invention is to provide a fastening structure of a tube and cap assembly, in which the cap can be secured directly to a mouth member of the tube without injuring a sealed mouth of the mouth member of tube until the sealed mouth is firstly opened.

Another object of the present invention is to provide a fastening structure of a tube and cap assembly, in which a sealed mouth of the tube can be broken without contaminating the environment.

The other object of the present invention is to provide a fastening structure of a tube and cap assembly, in which the cap can normally be screwed and unscrewed with respect to a mouth member of tube after a sealed mouth of the mouth member of tube is opened.

In order to accomplish the objects and advantages mentioned in the above, the present invention provides a fastening structure of a tube and cap assembly in which an unthreaded part is provided in the threaded portion of cap or of a mouth member of tube. The threaded portion including the unthreaded part is made of soft material, while the threaded member not having the unthreaded part is made of harder material. The unthreaded part acts as a stopper to keep the cap being secured to the mouth member of tube. Under this state, if the cap is forcibly screwed further, the threaded portion of harder material rolls on the unthreaded part of soft material to form threads on the unthreaded part. Due to this forcible action, a conical cutting edge, if it is provided on the inner bottom surface of cap, is pressed against the sealed mouth of tube to break the sealed mouth.

BRIEF DESCRIPTION OF THE DRAWINGS

These and other objects, features and advantages of the present invention will become apparent from the following descriptions of preferred embodiments taken in conjunction with the accompanying drawings in which:

FIG. 3(*b*) is a perspective view partly broken showing the tube mouth member and cap shown in FIG. 3(*a*);

FIG. 6(*b*) shows a front view of the tube mouth member and a cross-sectional view 45° turned around a center axis of the cap according to the present invention;

FIG. 6(*c*) shows a side view of the tube mouth member and a cross-sectional view of the cap shown in FIG. 6(*b*);

FIG. 6(*d*) is a cross-sectional view showing the tube mouth member with the cap being assembled thereto according to the present invention;

FIG. 6(*e*) is a cross-sectional view showing the tube mouth member shown in FIG. 6(*d*) but with the cap being screwed deeply; and FIG. 6(*f*) is a side view partly broken showing the threaded portions of tube mouth member and cap which are assembled together according to the present invention.

DETAILED DESCRIPTION OF THE EMBODIMENTS

Figure 1:
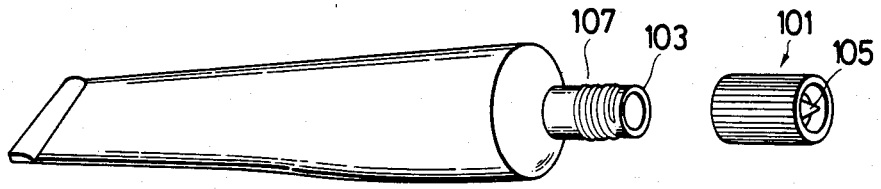
FIG. 1 is a perspective view showing a cap structure of a tube according to a prior art.
Figure 2:
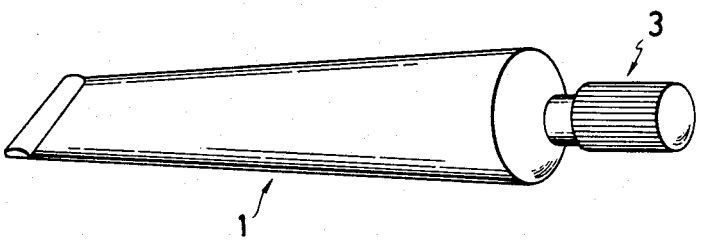
FIG. 2 is a perspective view showing the overall appearance of a tube according to the present invention.
Figure 3:
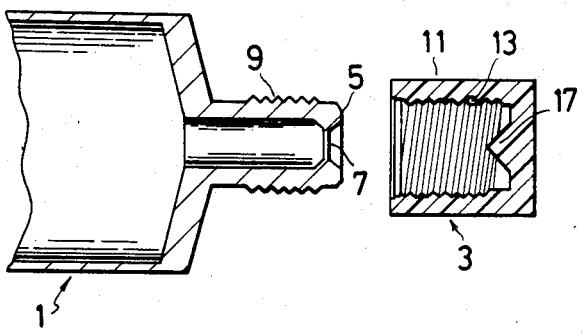
FIG. 3(*a*) is a cross-sectional view showing a tube mouth member and a cap according to the present invention.
Figure 3:
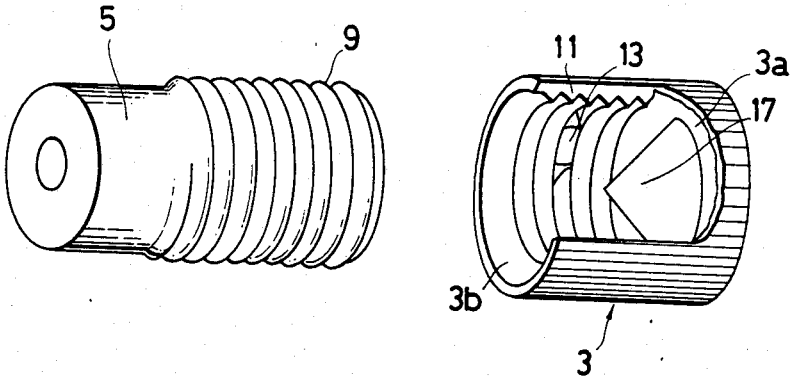
Figure 4:
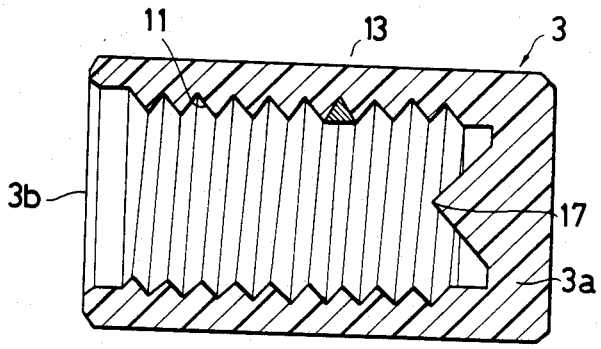
FIG. 4 is an enlarged cross-sectional view showing the cap shown in FIG. 3(*a*)

An embodiment of the present invention will now be described with reference to the accompanying drawings. In FIGS. 2 to 4, threads 9 provided on the periphery of a mouth member 5 of a tube 1 are made by hard material having strength. A cap 3 having threads which include an unthreaded stopper portion 13 is made by soft material capable of plastic deformation. On the inner bottom surface 3*a* of cap 3, there is provided a conical cutting edge 17. The unthreaded stopper portion 13 may be formed by filling soft material into a root of threads 11. The mouth member 5 projecting from a part of the tube 1 is provided with the threads 9 and a mouth film 7 which is formed at the mouth of mouth member 5 to seal it and prevent material filled in the tube 1 from flowing outside.

The threads 11 provided inside the cap 3 can freely be screwed and unscrewed with respect to the threads 9 of tube 1. The unthreaded stopper portion 13 occupies a part of root portion of the threads 11. The inner bottom portion 3*a* of cap 3 is provided with the conical cutting edge 17 to break the mouth film 7 of tube mouth member 5. The location of unthreaded stopper portion 13 is selected such that the cap 3 may stop at an intermediate stop position where the conical cutting edge 17 does not contact with the mouth film 7. A distance 15 from the unthreaded stopper 13 to the inner bottom portion 3*a* of cap 3 shall be equal to or smaller than a distance L from an opening end 3*b* of cap in the intermediate stop position to the shoulder of tube 1.

Figure 5:
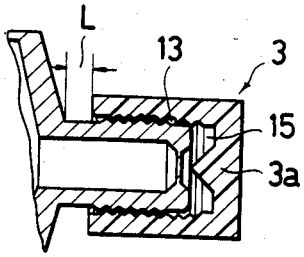
FIG. 5 is a cross-sectional view showing the main part of tube mouth and cap after manufacturing according to the present invention.
Figure 6:
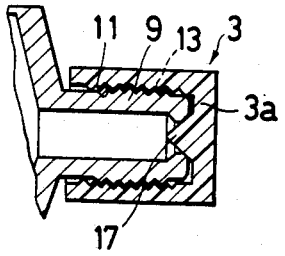
FIG. 6(*a*) is a cross-sectional view showing the main part of tube mouth and cap shown in FIG. 5 but in use.
Figure 6:
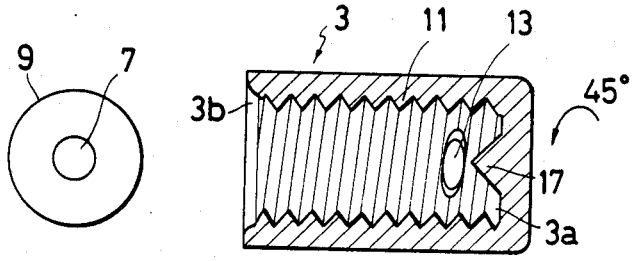
Figure 6:
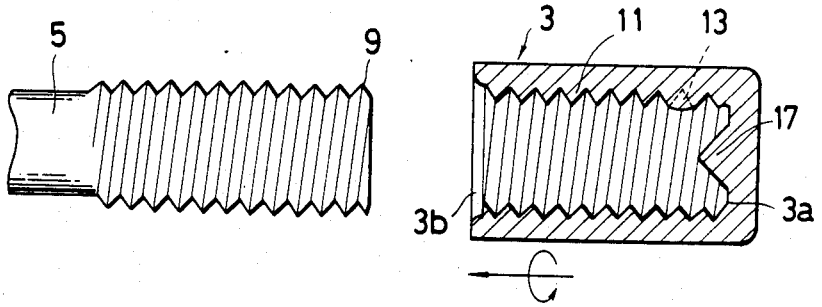
Figure 6:
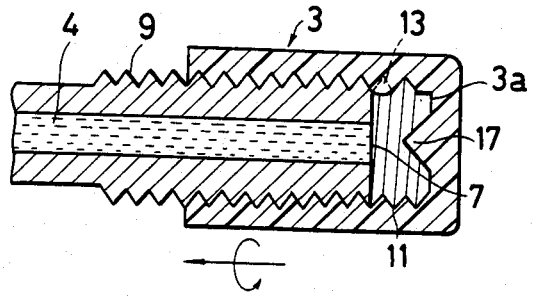
Figure 6:
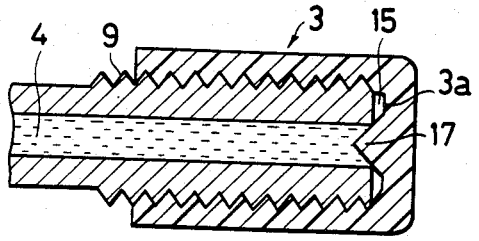
Figure 6:
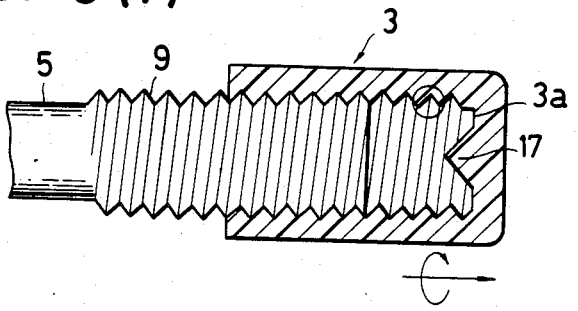

FIGS. 4 to 6 will now be described. If the cap 3 is screwed on the mouth member 5 of tube 1, and if the front end of threads 9 of cap 3 reaches the unthreaded stopper portion 13 of threads 11, the screwing motion between the threads 9 and 11 is stopped by the unthreaded stopper portion 13. The threads 9 are made by hard material having strength, while the threads 11 including the unthreaded stopper portion 13 by soft material which may be plastically deformed by the threads 9. When the threads 9 reach the unthreaded stopper portion 13 and are stopped thereby, the front end portion of threads 9 bites into the stopper 13 of soft material. The magnitude of the biting can be adjusted by adjusting the fastening torque in screwing the cap 3. In this case, the maximum fastening torque shall be set such that the threads 9 will not entirely roll through the unthreaded stopper portion 13. Due to the biting between the threads 9 and the unthreaded stopper 13, the cap 3 is fixed with the mouth member 5 of tube 1 at the intermediate position. Under this condition, the tube is delivered from a manufacturer to a consumer.

To open the mouth film 7 of tube 1, the cap 3 is forcibly screwed on the mouth member 5 of tube 1. Then, the threads 9 of hard material roll on the unthreaded stopper portion 13 formed by filling soft material into the root portion of threads 11 and form successively threads on the unthreaded stopper portion 13 according to a thread rolling principle. Accordingly, the tip of conical cutting edge 17 provided on the inner bottom surface of cap 3 is pressed against the mouth film 7 to break it, thereby completing the opening operation of the tube 1. After that, the conical surface of cutting edge 17 contacts with the inner front end of mouth member 5 so that the cap 3 may seal the tube 1. Once the cap 3 opens the mouth film 7 of tube 1, the stopper portion 13 will never return to its original unthreaded shape but will be kept threaded.

According to the present invention, as mentioned in the above, the unthreaded stopper portion 13 is provided in the threads 9 of tube mouth member 5 or in the threads 11 of cap 3 so that the cap 3 may be stopped at the position of the unthreaded stopper portion 13 after the cap 3 being screwed on the mouth member 5 with certain fastening torque to keep the mouth film 7 of mouth member 5 not broken. If it is required to open the mouth film 7, the cap is further screwed on the mouth member 5 to break the mouth film 7 with the conical cutting edge 17. Namely, due to the provision of the unthreaded stopper portion 13 and cutting edge 17, the mouth film 7 of mouth member 5 can be kept uninjured or can be broken when required only by the function of cap 3 without requiring additional elements.

It shall be understood that the present invention is not limited to the embodiment described in the above and that various modifications of the present invention will be achieved.

What is claimed is:

1. A fastening structure of a tube and cap assembly, comprising:

a mouth member projecting outwardly from said tube;

a first threaded portion formed on the periphery of said mouth member;

a cap with a second threaded portion formed on the inner surface thereof, said second threaded portion being screwed on said first threaded portion of said mouth member to constitute a tube and cap assembly and being selectively unscrewable therefrom;

one of said threaded portions made of material having a certain predetermined degree of hardness;

an unthreaded stopper portion formed on the other of said threaded portions, said unthreaded stopper portion made of plastic material softer than the hardness of said one threaded portion such that the screwing motion of said cap on said mouth member toward said tube is stopped by the stopper portion when said cap is screwed with torque not exceeding a limit value; and, when said cap is screwed with torque exceeding the limit value, said screwing motion of said cap plastically deforms said unthreaded stopper portion to overcome the resistance of the unthreaded stopper portion and is continued until a leading end inner surface of said cap abuts against a part of said mouth member.

2. The fastening structure as in claim 1, wherein:

said unthreaded stopper portion and said other threaded portion are unitary and are both softer than the hardness of said one threaded portion; and the plastic material of said unthreaded stopper portion undergoes permanent threaded deformation in response to said deformation by the cap and thereafter remains deformed, whereby the cap thereafter can be screwed on said tube to abut said mouth member and thereby close the mouth member, without interference by said stopper portion.

3. A fastening structure as in claim 1, wherein said unthreaded stopper portion is bitten by the front end portion of said one threaded portion if said cap is screwed on said mouth member toward said tube with torque not exceeding the limit torque, said biting action causing said cap to be held on said mouth member of tube.

4. A fastening structure as in claim 3, wherein said unthreaded stopper portion is operative to undergo rolling and plastic deformation by said first threaded portion to form threads thereon for passing said one threaded portion thereover, if said cap is screwed on said mouth member toward said tube with torque exceeding said limit torque.

5. A fastening structure as in claim 4 comprising further a mouth film formed at the mouth of said mouth member of the tube to seal said mouth member.

6. A fastening structure as in claim 5 comprising further a conical cutting edge formed on an inner bottom surface of said cap in alignment with said mouth film.

7. A fastening structure as in claim 6, wherein said unthreaded stopper portion is positioned at a location where said conical cutting edge is stopped and secured to keep a gap between said cutting edge and the surface of said mouth film by said unthreaded stopper portion when said cap is screwed on said mouth member toward said tube with torque not exceeding the limit value, and where said conical cutting edge is advanced over said unthreaded stopper portion to break said mouth film with said conical cutting edge when said cap is screwed on said mouth member toward said tube with torque exceeding the limit value.

8. A fastening structure as in claim 7, comprising a peripheral surface surrounding said conical cutting edge to cover the mouth of said mouth member of the tube after said mouth film is broken by said conical cutting edge.

9. A fastening structure as in claim 8, wherein said unthreaded stopper portion is formed by filling soft material into a part of a root portion of said other threaded portion.

* * * * *